US010082759B2

(12) United States Patent
Kitamura

(10) Patent No.: US 10,082,759 B2
(45) Date of Patent: Sep. 25, 2018

(54) SHEET PROCESSING DEVICE AND IMAGE FORMING SYSTEM

(71) Applicant: Konica Minolta, Inc., Tokyo (JP)

(72) Inventor: Kei Kitamura, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 408 days.

(21) Appl. No.: 14/938,508

(22) Filed: Nov. 11, 2015

(65) Prior Publication Data

US 2016/0132014 A1 May 12, 2016

(30) Foreign Application Priority Data

Nov. 11, 2014 (JP) ..... 2014-229029

(51) Int. Cl.

| | |
|---|---|
| ***G03G 15/00*** | (2006.01) |
| ***B65H 37/04*** | (2006.01) |
| ***B65H 37/06*** | (2006.01) |
| ***B31F 5/02*** | (2006.01) |

(52) U.S. Cl.

CPC ..... *G03G 15/6541* (2013.01); *B31F 5/027* (2013.01); *B65H 37/04* (2013.01); *B65H 37/06* (2013.01); *B65H 2408/125* (2013.01); *G03G 2215/00827* (2013.01); *G03G 2215/00877* (2013.01)

(58) Field of Classification Search

CPC ..... G03G 15/6541; B31F 5/027; B65H 37/04; B65H 37/06

USPC ..... 270/52.18, 58.08; 227/84, 93, 142

See application file for complete search history.

(56) References Cited

U.S. PATENT DOCUMENTS

| | | | | |
|---|---|---|---|---|
| 6,142,353 | A * | 11/2000 | Boss | B42B 4/00 227/100 |
| 7,637,489 | B2 * | 12/2009 | Brunner | B42B 4/00 270/52.14 |
| 7,780,157 | B2 * | 8/2010 | Brunner | B42B 4/00 227/84 |
| 8,523,039 | B2 * | 9/2013 | Sugihara | B27F 7/006 227/110 |
| 2011/0011913 | A1 | 1/2011 | Schneider et al. | |

FOREIGN PATENT DOCUMENTS

| | | | |
|---|---|---|---|
| JP | 2005089021 | A | 4/2005 |
| JP | 2011-514847 | A | 5/2011 |
| JP | 2012-176808 | A | 9/2012 |

OTHER PUBLICATIONS

Office Action issued in corresponding Japanese Application No. 2014-229029 dated Nov. 15, 2016, and English translation thereof (8 pages).

* cited by examiner

*Primary Examiner* — Nathaniel Chukwurah
(74) *Attorney, Agent, or Firm* — Osha Liang LLP

(57) ABSTRACT

A sheet processing device includes: an accumulator on which sheets are accumulated; a staple driver; a staple receiver disposed at a position facing the staple driver, wherein the staple driver drives a staple into the sheets when the sheet are between the staple receiver and the staple driver; an arm that extends from the staple driver in a direction perpendicular to a staple driving direction to operate the staple driver in the staple driving direction; and a regulator that regulates deviation produced when the staple driver drives the staple. The deviation is in a short length direction of the arm perpendicular to a long length direction of the arm and to the staple driving direction.

10 Claims, 8 Drawing Sheets

SHEET PROCESSING DEVICE AND IMAGE FORMING SYSTEM

The entire disclosure of Japanese Patent Application No. 2014-229029 filed on Nov. 11, 2014 including description, claims, drawings, and abstract are incorporated herein by reference in its entirety.

BACKGROUND OF THE INVENTION

Technical Field

The present invention relates to a sheet processing device and an image forming system.

Background Art

There is known a sheet processing device which includes a binding unit provided with an accumulator on which sheets are accumulated, a staple driver for driving a staple from above into a predetermined position of the accumulated sheets, and a staple receiver disposed opposed to the staple driver with the sheets sandwiched between the staple receiver and the staple driver to receive a tip of the staple driven from the staple driver and bend the tip of the staple. The sheet processing device produces a booklet by using the binding unit.

For example, JP 2012-176808 A proposes this type of saddle stitching unit which includes a saddle unit on which creased V-shaped sheets are accumulated in a straddling state over the saddle unit, and a staple driver supported on an arm extended in a direction crossing a ridge direction of the saddle unit at right angles in a horizontal plane. According to this configuration, a staple is driven by upward movement of a staple receiving portion disposed below the saddle unit.

According to the device disclosed in JP 2012-176808 A, the arm extends in a long length direction of the arm. In this case, the rigidity of the staple driver in a short length direction of the arm becomes relatively low. Accordingly, twisting force in the short length direction generated during the staple driving operation may produce mechanical deviation, and cause a shift of a binding position from a predetermined position. Moreover, this twisting force prevents driving of the staple in an appropriate manner, and causes buckling of the staple in some cases.

SUMMARY

One or more embodiments of the present invention provide a sheet processing device and an image forming system capable of reducing effects of mechanical deviation produced during a binding process.

According to one or more embodiments of the present invention, a sheet processing device includes: an accumulator on which sheets are accumulated; a staple driver; a staple receiver disposed at a position facing the staple driver, wherein of the staple driver drives a staple into the sheets when the sheets are between the staple receiver and the staple driver; an arm that extends from the staple driver in a direction perpendicular to a staple driving direction to operate the staple driver in the staple driving direction; and a regulator that regulates deviation produced when the staple driver drives the staple. The deviation is in a short length direction of the arm perpendicular to a long length direction of the arm and to the staple driving direction.

According to one or more embodiments of the present invention, an image forming system includes: an image forming device that forms an image on a sheet; and the sheet processing device described above that performs a binding process for binding sheets via a staple after images are formed on the sheets by the image forming device.

BRIEF DESCRIPTION OF THE DRAWINGS

One or more embodiments of the present invention will become more fully understood from the detailed description given hereinbelow and the appended drawings which are given by way of illustration only, and thus are not intended as a definition of the limits of the present invention, and wherein.

DETAILED DESCRIPTION OF EMBODIMENTS

Hereinafter, one or more embodiments of an image forming system 1 according to the present invention will be described with reference to the drawings. However, the scope of the invention is not limited to the illustrated examples.

Figure 1:
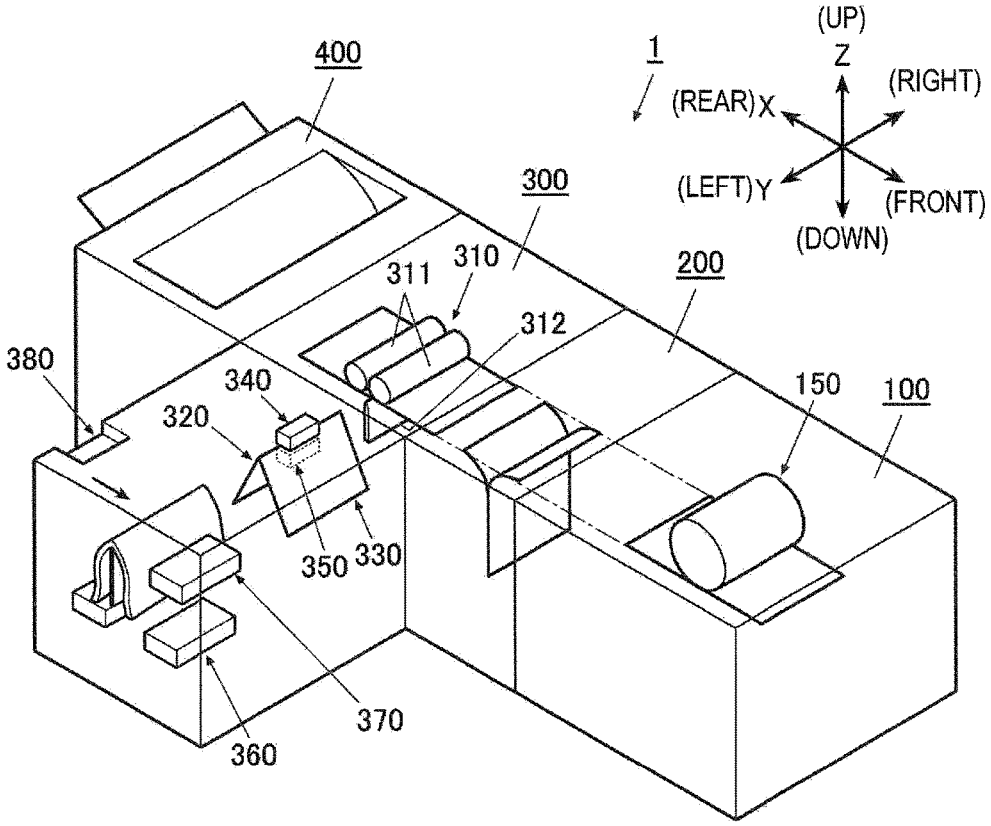
FIG. 1 is a schematic view illustrating a general configuration of an image forming system according to one or more embodiments of the invention.

FIG. 1 is a schematic view illustrating a general configuration of the image forming system 1 according to one or more embodiments.

The image forming system 1 includes an image forming device 100, an intermediate conveyance device 200, a sheet processing device 300, and a side stitching device 400.

In the following description, X, Y, and Z directions are defined as follows. The vertical direction corresponds to the Z direction. The direction of connection between the image forming device 100, the intermediate conveyance device 200, the sheet processing device 300, and the side stitching device 400 illustrated in FIG. 1 corresponds to the X direction. The direction perpendicular to the X direction and the Z direction corresponds to the Y direction.

In addition, the front side and the rear side are defined with respect to the X direction, the right side and the left side are defined with respect to the Y direction, and the upper side and the lower side are defined with respect to the Z direction. In this case, the front side corresponds to the upstream side in a conveyance direction of the image forming system 1, while the rear side corresponds to the downstream side in this conveyance direction. The right side corresponds to the upstream side of a sheet conveyance direction of the sheet processing device 300 during a center folding and saddle stitching process, while the left side corresponds to the downstream side in this sheet conveyance direction.

The image forming device 100 forms an image on a sheet.

More specifically, the image forming device 100 includes a conveyance unit which draws a sheet accumulated on a sheet tray as a recording medium from the sheet tray and conveys the sheet, a developing unit which develops a toner image corresponding to bitmap data on a primary transfer member such as a transfer roller, a primary transfer unit which transfers the toner image developed on the primary transfer member to a secondary transfer member such as a transfer drum 150, a secondary transfer unit which transfers the toner image transferred to the secondary transfer member to the sheet conveyed by the conveyance unit, a fixing unit which fixes the transferred toner image to the sheet, a discharge unit which discharges the sheet subjected to a fixing process by the fixing unit, and other components, for example, to form an image on the sheet.

In addition, the image forming device 100 passes the sheet discharged after formation of the image to the intermediate conveyance device 200. In other words, the image forming system 1 is assembled such that the sheet discharged from the image forming device 100 enters the intermediate conveyance device 200.

The intermediate conveyance device 200 is a device capable of temporarily stopping the sheet, and creasing and cutting the sheet put on standby.

More specifically, the intermediate conveyance device 200 includes a standby unit (stacker) which conveys the sheet received from the image forming device 100 in the downward direction, and temporarily stops the sheet in such a state that the sheet surface of the sheet extends substantially in the Z direction to put the sheet on standby, an intermediate alignment unit which aligns the position of the sheet put on standby, a creasing unit (creaser) which creases the aligned sheet, a margin cutting unit (slitter) which cuts a margin of the sheet, and other components, for example.

More specifically, the standby unit of the intermediate conveyance device 200 temporarily stops the sheet received from the image forming device 100. The intermediate alignment unit aligns the sheet in the state of temporary stop. The creasing unit performs a creasing process for creasing the aligned sheet. The margin cutting unit cuts the margin of the creased sheet while conveying the sheet. Then, the intermediate conveyance device 200 passes the sheet to the sheet processing device 300 after the margin cutting unit cuts off the margin of the sheet.

The intermediate conveyance device 200 may pass the sheet received from the image forming device 100 to the sheet processing device 300 while omitting a part or all of the respective processes performed by the intermediate conveyance device 200.

The sheet processing device 300 is a device which performs a center-folding process for folding a sheet at the center (folded in half), a saddle stitching process for producing a saddle-stitch booklet by overlapping and binding a predetermined number of center-folded sheets, a cutting process for cutting edges of the saddle-stitched booklet, a square back forming process for forming a square back of the saddle-stitched booklet as a spine of the booklet, and others.

More specifically, the sheet processing device 300 includes a center-folding unit 310 which folds the sheets received from the intermediate conveyance device 200 at the center in the Y direction, a saddle stitching unit 320 which overlaps the sheets center-folded by the center-folding unit 310, and drives staples into the overlapped sheets to form a saddle-stitch booklet, a cutting unit 360 which performs a cutting process for cutting edges of the saddle-stitched booklet, a square back forming unit 370 which performs a square back forming process for forming the spine of the saddle-stitch booklet, a discharging unit 380 which discharges the saddle-stitched booklet to the outside, and others, for example.

The sheet processing device 300 may pass the sheets received from the intermediate conveyance device 200 to the side stitching device 400 while omitting a part or all of the respective processes performed by the sheet processing device 300.

The center-folding unit 310 includes a pair of center-folding rollers 311, 311 and a plate-shaped folding knife 312 disposed below the pair of center-folding rollers 311, 311 and extending in the Y-Z plane. The folding knife 312 is movable in such a manner as to enter a space between the pair of center-folding rollers 311, 311.

A sheet received from the image forming device 100 is conveyed to a position where the center of the sheet in the X direction faces the folding knife 312. When the sheet reaches this position, the folding knife 312 enters the space between the pair of center-folding rollers 311, 311 to push the sheet into a nip portion. As a result, the sheet is folded at the center and creased at a contact position between the sheet and the folding knife 312 to form a crease extending in the Y direction in the sheet. More specifically, the sheet is formed into a sheet in V-shape (V-shaped sheet). In this state, the crease of the sheet is positioned on the upper side, while both edges of the sheet are positioned on the lower side.

The center-folded sheet is conveyed in a direction along the crease (Y direction) by a not-shown conveyance unit, and reaches the saddle stitching unit 320.

Figure 2:
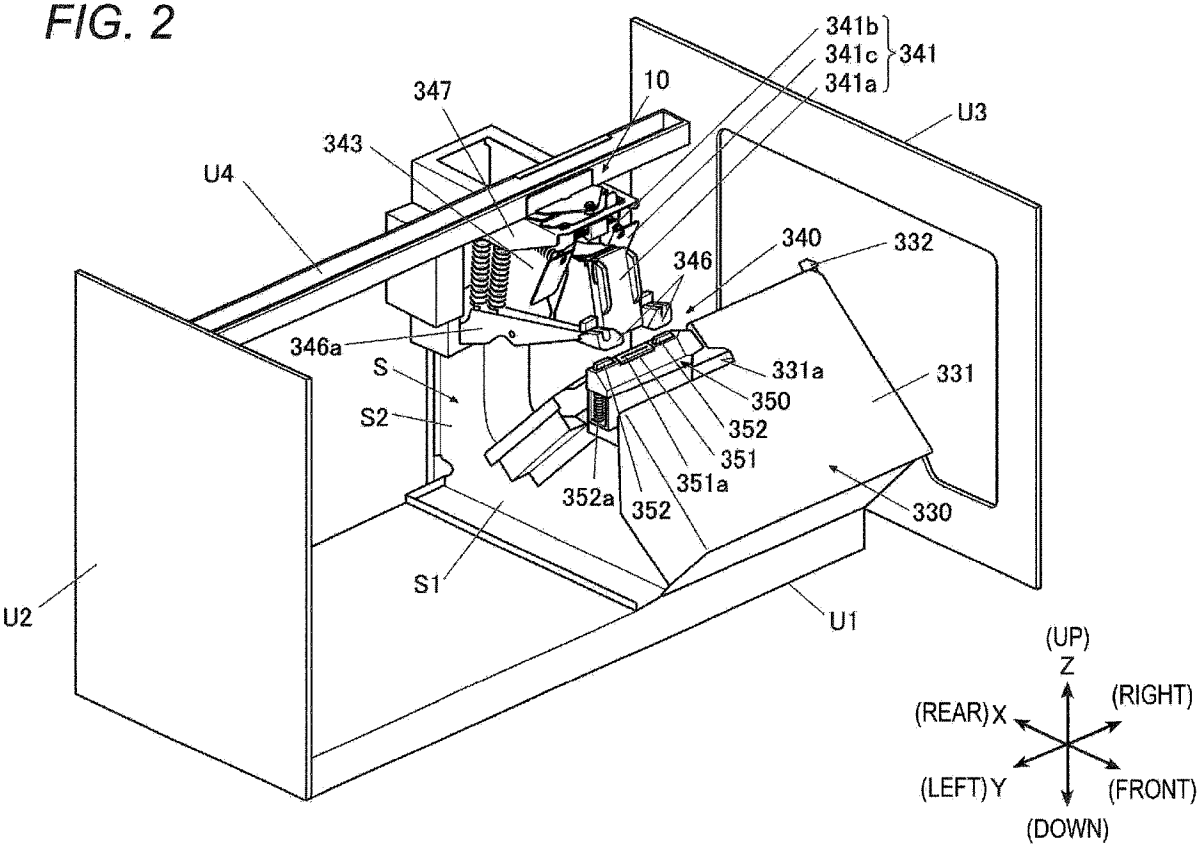
FIG. 2 is a schematic perspective view illustrating an example of a configuration of a saddle stitching unit of a sheet processing device according to one or more embodiments of the invention.

FIG. 2 is a perspective view illustrating an example of a configuration of the saddle stitching unit 320 according to one or more embodiments.

As illustrated in FIG. 2, the saddle stitching unit 320 is mounted within a storage space U formed by a substrate U1, a pair of left and right panels U2 and U3 standing on one and the other sides of the substrate U1, respectively, and a stay U4 extending between upper regions of the panels U2 and U3. The substrate U1, the panels U2 and U3, and the stay U4 constitute the framework of the sheet processing device 300.

The saddle stitching unit 320 includes an accumulator 330 where sheets conveyed by the center-folding unit 310 are placed, a staple driving unit 340 disposed above the accumulator 330, a staple receiver 350 disposed inside the accumulator 330, a support unit S for supporting these units, and a connection mechanism 10 for connecting the staple driving unit 340 to the stay U4 located above.

The support unit S includes a base portion S1 extending in the X direction, and a standing portion S2 standing from the base end of the base portion S1. The accumulator 330 and the staple receiver 350 are provided at the front end of the base portion S1, while the staple driving unit 340 is provided at the upper end of the standing portion S2.

The accumulator 330 includes a saddle portion 331 on which sheets conveyed from the center-folding unit 310 are overlapped and accumulated, for example.

The saddle portion 331 has a projecting shape whose upper region has an angle of substantially 90 degrees. The V-shaped sheets conveyed from the center-folding unit 310 are placed on the upper region of the saddle portion 331 in a straddling state over the upper region.

A sheet constituting one booklet is discharged to the saddle portion 331 every time the center-folding process is completed, and sequentially accumulated in such a state that a sheet corresponding to the innermost page of the booklet to be formed lies on the lowermost surface.

A notch 331*a* is formed in a left end side upper region of the saddle portion 331. The notch 331*a* is a notch through which the upper region of the staple receiver 350 disposed inside the saddle portion 331 is exposed.

A tip side aligning unit (not shown) is disposed on the downstream side of the saddle portion 331 in the sheet conveyance direction. The tip side aligning unit stops a sheet traveling from the right side to the left side along the saddle portion 331 in the conveyance direction by abutting the tip of the sheet.

A rear end side aligning unit 332 is disposed on the right end side upper region of the saddle portion 331. The rear end side aligning unit 332 is movable in the Y direction along a ridge formed at the top of the saddle portion 331. When a sheet is placed on the saddle portion 331, the rear end side aligning unit 332 reciprocates along the ridge at the top of the saddle portion 331 in the Y direction, and slightly hits the rear end of the sheet in the conveyance direction to align the sheet in the conveyance direction.

Figure 3:
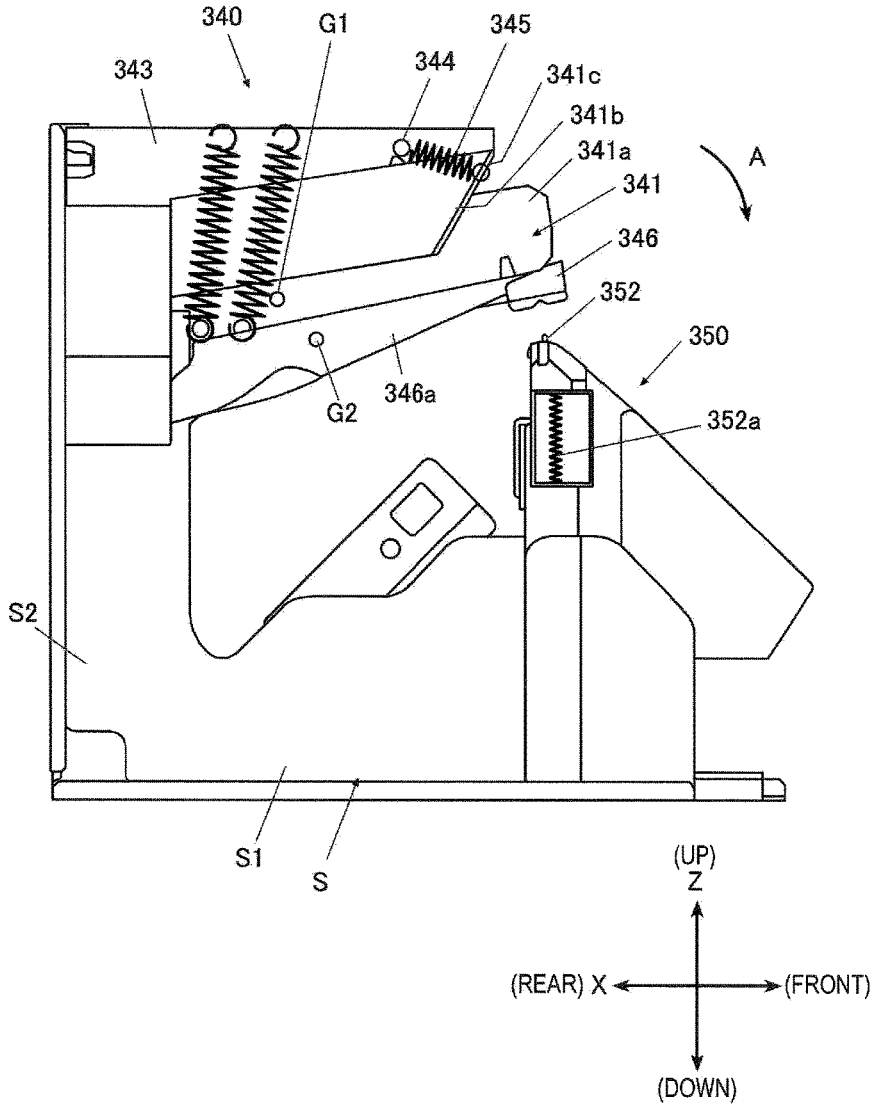
FIG. 3 is a side view illustrating an example of a configuration of the saddle stitching unit of a sheet processing device according to one or more embodiments of the invention.

FIG. 3 is a side view illustrating the staple driving unit 340 as viewed from the left side according to one or more embodiments. FIG. 3 does not show a left side wall 343 of a body 341, and the connection mechanism 10 disposed above the staple driving unit 340.

The staple driving unit 340 includes the body 341 which drives a staple into sheets placed on the saddle portion 331, and two presses 346, 346 arranged in the Y direction with the body 341 interposed between the two presses 346, 346.

Figure 4:
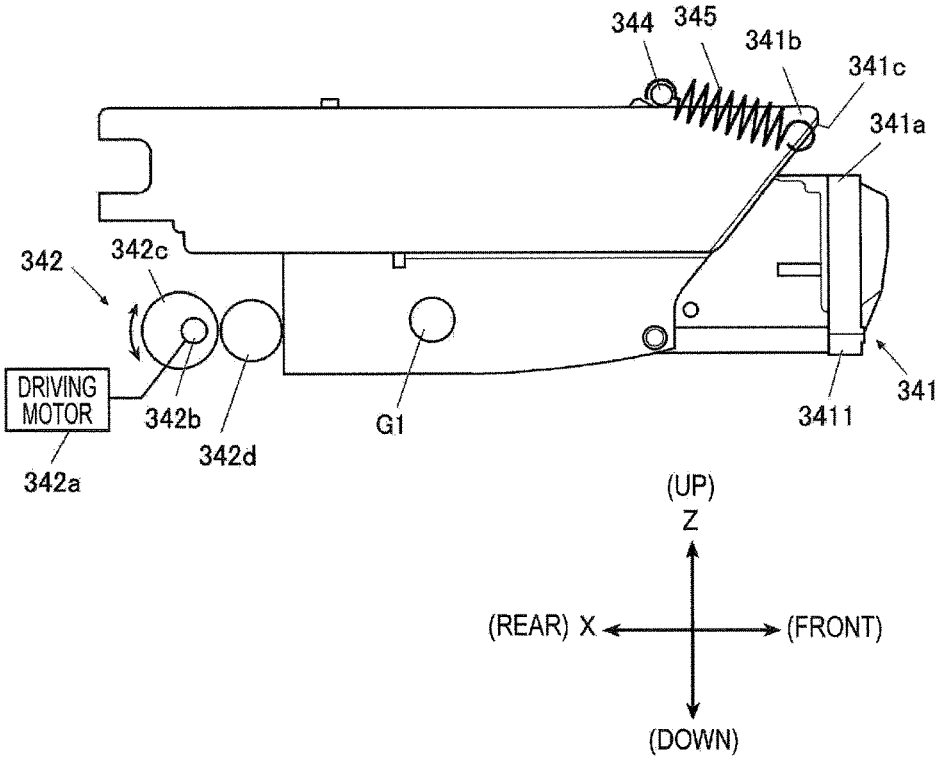
FIG. 4 is a schematic view illustrating a staple driver of a staple driving unit according to one or more embodiments of the invention.

FIG. 4 is a schematic view illustrating the body 341 of the staple driving unit 340 according to one or more embodiments.

The body 341 includes an arm 341*a* extending in the X direction, with staples stored at the front end thereof. The body 341 further includes a cover portion 341*b* covering an upper region of the arm 341*a*. The rear end of the body 341 is supported by the standing portion S2 (see FIG. 3).

The arm 341*a* and the cover portion 341*b* move as one piece body in the X direction. However, at the time of driving of a staple, only the arm 341*a* rotates relative to the cover portion 341*b*. In the following description, the X direction is referred to as a long length direction of the arm 341*a*, while the Y direction is referred to as a short length direction of the arm 341*a*. The short length direction of the arm 341*a* (Y direction) is perpendicular to the long length direction of the arm 341*a* (X direction), and to the staple driving direction (Z direction).

A driving mechanism 342 is provided behind the body 341 to drive the body 341 in the X direction.

The side walls 343, 343 are disposed on the left and right sides of the body 341, respectively, (see FIG. 2).

A support portion 344 extending in the Y direction is disposed above the front side of the body 341 while being supported by the side walls 343, 343 at both ends of the support portion 344.

The arm 341*a* includes a staple driver 3411 which drives a staple into sheets (a bundle of sheets) accumulated at the front end of the arm 341*a*. The staple driver 3411 is disposed above the accumulator 330. A driving opening (not shown) through which a staple is driven is formed in the lower surface of the staple driver 3411.

The arm 341*a* extends in the X direction, and rotates in a direction of an arrow A in FIG. 3 around a rotational axis G1 in accordance with driving of a driving motor M1 (see FIG. 7) to drive a staple via the staple driver 3411 at the time of contact between the staple driver 3411 and a sheet. In this case, a staple is driven from the staple driver 3411 in the up-down direction corresponding to a staple driving direction.

A standing plate 341*c*, 341*c* provided in a front region of the cover portion 341*b* extends in the left-right direction from each side of the cover portion 341*b*. An urging member 345, 345 is provided on each of the standing plates 341*c*, 341*c* to urge the body 341 rearward.

Each of the urging members 345, 345 is formed by an extension spring, for example. Each of the urging members 345, 345 urges the body 341 rearward with the front end of the urging member 345, 345 connected with the upper region of the standing plate 341*c*, and with the rear end of the urging member 345, 345 connected with the support portion 344.

The driving mechanism 342 includes a driving motor 342*a*, a rotational shaft 342*b* rotating in accordance with driving of the driving motor 342*a*, an eccentric cam 342*c* connected with the rotational shaft 342*b*, a pushing member 342*d* in contact with the eccentric cam 342*c*, and further in contact with the arm 341*a* from the rear side, and others.

When the eccentric cam 342*c* rotates frontward through a predetermined angle by rotation of the rotational shaft 342*b* in accordance with the driving of the driving motor 342*a*, the pushing member 342*d* shifts frontward. As a result, the arm 341*a* and the body 341 shift frontward while resisting the urging force of the urging members 345, 345.

On the other hand, the pushing member 342*d* shifts rearward in accordance with rearward rotation of the eccentric cam 342*c* through a predetermined angle. As a result, the arm 341*a* and the body 341 shift rearward by the urging force of the urging members 345, 345.

The staple driver 3411, driven by the driving mechanism 342 in accordance with the thickness of the bundle of sheets under a sheet processing control unit 505, comes to a position facing a sheet binding position of the bundle of sheets closest to the staple driver 3411 (see steps S1 through S3 in FIG. 8 to be described below).

A protection member 347 (see FIG. 2) for covering an upper region of the body 341 is provided on the upper region of the body 341.

The protection member 347 is a plate body having a size and a shape sufficient for covering the body 341 from above, and is attached to the upper surface of the cover portion 341*b*.

Returning to FIG. 3, the presses 346, 346 are disposed in such positions as to face support portions 352, 352 provided on the staple receiver 350. The presses 346, 346 are disposed at positions shifted from the staple driver 3411 in the short length direction of a second arm 346*a* (Y direction) (see FIG. 2).

The presses 346, 346 are provided on the side walls 343, 343 via the second arm 346*a* extending in the X direction. In the following description, the X direction is referred to as the long length direction of the second arm 346*a*, while the Y direction is referred to as the short length direction of the second arm 346*a*. Accordingly, the long length direction and the short length direction of the second arm 346*a* coincide with the long length direction and the short length direction of the arm 341*a*. The short length direction of the second arm 346*a* (Y direction) is perpendicular to the long length direction of the second arm 346*a* (X direction), and to the staple driving direction (Z direction).

When a predetermined number of sheets for constituting one booklet are placed on the saddle portion 331, the presses 346, 346 move downward by rotation of the second arm 346*a* around a rotational axis G2 in a direction of an arrow A in FIG. 3 in accordance with driving of the driving motor M2 (see FIG. 7) to press the sheets on the saddle portion 331 in cooperation with the support portions 352, 352. Positions of the sheets to be pressed by the presses 346, 346 are positions shifted from the binding position of the bundle of sheets in the short length direction of the second arm 346*a* (Y direction). After completion of the actions of the presses 346, 346 for moving downward and pressing the sheets on the saddle portion 331 in cooperation with the support portions 352, 352, the body 341 starts driving of staples.

Returning to FIG. 2, the staple receiver 350 includes a staple receiving portion 351 provided inside the saddle portion 331, and the two support portions 352, 352 arranged in the Y direction with the staple receiving portion 351 interposed between the support portions 352, 352.

The staple receiving portion 351 is fixed to the inside of the saddle portion 331. The upper region of the staple receiving portion 351 is exposed through the notch 331*a* of the saddle portion 331. A recess 351*a* is formed in the upper surface of the staple receiving portion 351. The recess 351*a* is a portion for abutting a tip of a staple driven by the body 341 and bending the tip of the staple. The tip of the staple pressed against the sheet by the body 341 penetrates the sheet, and abuts the recess 351*a* to be bended by the recess 351*a*.

The width of the recess 351*a* in the X direction is set to 2.3 mm, for example.

Generally, the width of the recess 351*a* in the X direction is approximately 0.2 mm which is slightly larger than the width of a staple. However, the body 341 shifts in the X direction according to this embodiment, wherefore the width of the recess 351*a* in the X direction is set to a large length to allow secure contact between the recess 351*a* and the tip of the staple.

The support portions 352, 352 are provided in positions facing the presses 346, 346 of the staple driving unit 340, and hold a sheet sandwiched between the support portions 352, 352 and the presses 346, 346 when the presses 346, 346 move downward.

Each upper end of the support portions 352 projects from the upper surface of the staple receiving portion 351, while being supported by a spring member 352*a* which urges the support portion 352 in an upward projecting direction. When the press 346 moves downward, the support portion 352 retreats downward by a press of the press 346. This structure crushes the position into which a staple is driven on the ridge of the sheet.

Figure 5:
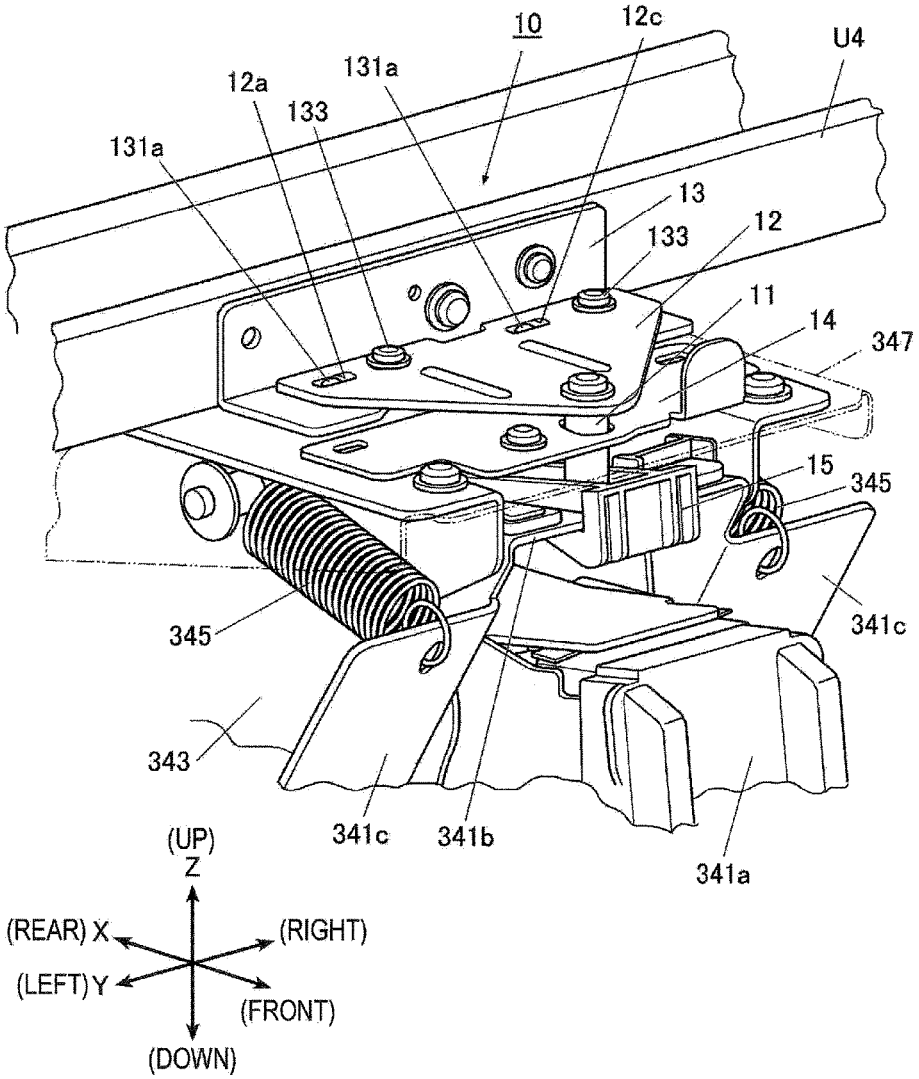
FIG. 5 is a perspective view illustrating a connection mechanism of the staple driving unit according to one or more embodiments of the invention.
Figure 6:
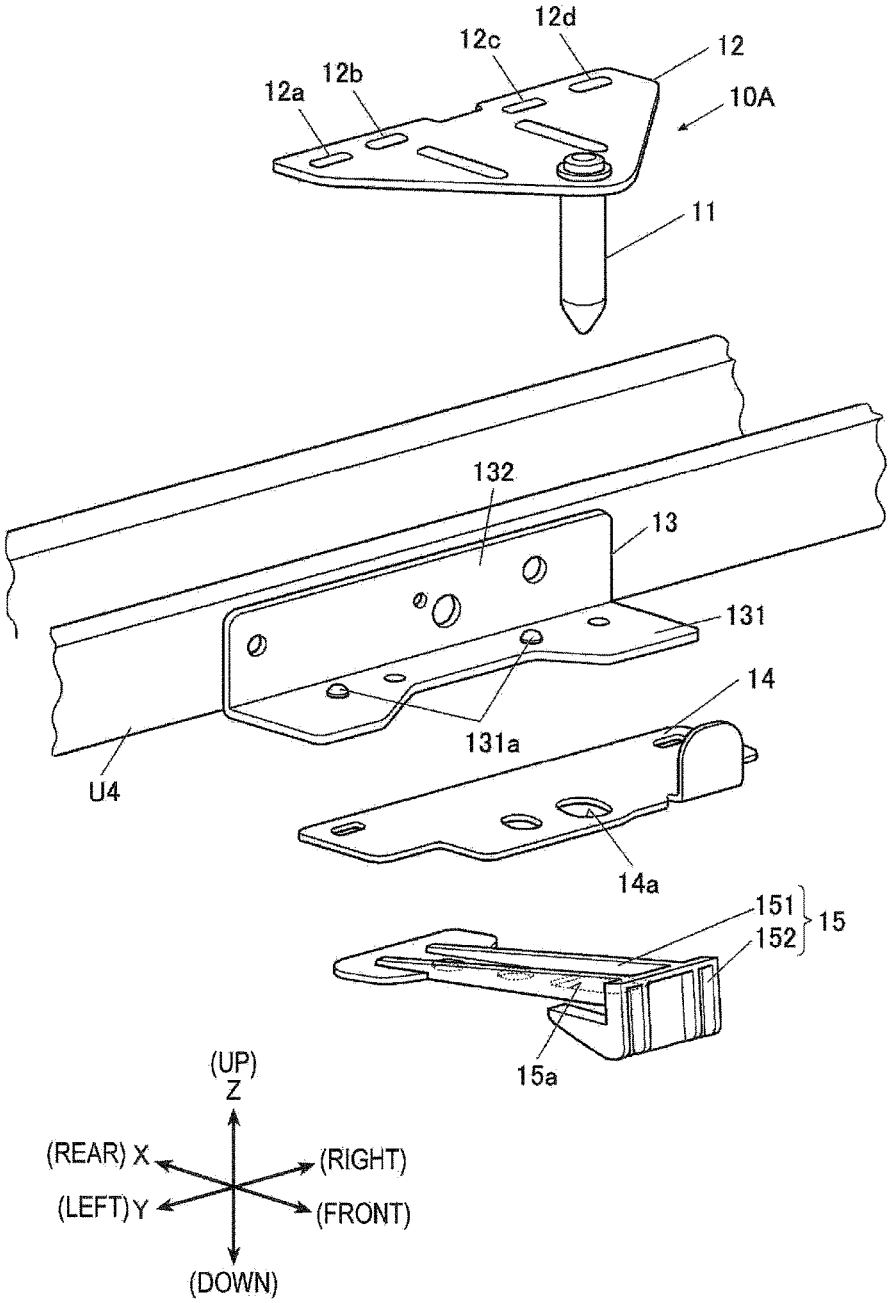
FIG. 6 is an exploded perspective view illustrating respective parts of the connection mechanism illustrated in FIG. 5.

FIG. 5 is an enlarged view illustrating a main part of the connection mechanism 10 according to one or more embodiments. FIG. 6 is an exploded perspective view illustrating respective components of the connection mechanism 10 according to one or more embodiments.

The connection mechanism 10 includes a pin (shaft) 11, a pin holding member 12 which holds the pin 11, a pin fixing member 13 which fixes the pin holding member 12 in a state supported from below, a second guide (second guide portion) 14 which resides above the protection member 347 provided on the body 341 of the staple driving unit 340, and includes a insertion hole 14*a* through which the pin 11 is inserted, and a first guide (guide portion) 15 attached to the body 341 of the staple driving unit 340 below the protection member 347, and including a insertion hole 15*a* through which the pin 11 is inserted, for example. The pin 11 and the first guide member 15 function as a regulator for regulating mechanical deviation in the Y direction produced when a staple is driven by the staple driver 3411. The pin 11 and the second guide member 14 function as a second regulator for regulating mechanical deviation in the Y direction produced when the presses 346, 346 press a sheet. The pin 11 and the pin holding member 12 are collectively referred to as a shaft 10A.

The upper end of the pin 11 is held by the pin holding member 12.

The pin 11 is so provided as to extend in the up-down direction, and inserted through the insertion hole 14*a* of the second guide member 14 and the insertion hole 15*a* of the first guide member 15.

The material of the pin 11 is not particularly limited. For example, the pin 11 may be made of resin or metal. The pin 11 may be made of metal in view of strength.

The pin holding member 12 is a substantially triangular plate body whose front center projects frontward. This projecting front center of the pin holding member 12 is a portion to which the upper end of the pin 11 is fixed, while the rear side of the pin holding member 12 is supported on and fixed to the pin fixing member 13. The pin holding member 12 includes engaging grooves 12*a*, 12*b*, 12*c*, and 12*d*. The engaging grooves 12*a* and 12*c* engage with projections 131*a*, 131*a* of the pin fixing member 13, respectively, which will be described below. The engaging grooves 12*b* and 12*d* engage with screws 133, 133.

The pin fixing member 13 is a plate body which has an L shape in the cross-sectional view and includes a support portion 131 extending horizontally to the X-Y plane, and a standing portion 132 rising from the rear end of the support portion 131.

The support portion 131 includes the projections 131*a*, 131*a* and supports the pin holding member 12 from below in a state of engagement between the projections 131*a*, 131*a* and the engaging grooves 12*a* and 12*c*. In this state, the screws 133, 133 are fastened into the engaging grooves 12*b* and 12*d* to be fixed to the engaging grooves 12*b* and 12*d*. Each of the engaging grooves 12*a*, 12*b*, 12*c*, and 12*d* has a predetermined width, wherefore the position of the shaft 10A held by the pin fixing member 13 is adjustable. Accordingly, the position of the shaft 10A with respect to the stay U4 is adjustable when the shaft 10A is held on the stay U4 via the pin fixing member 13. The standing portion 132 is screwed to the stay U4 located above to be fixed to the stay U4.

The lower surface of the support portion 131 of the pin fixing member 13 is in a state supported by the protection member 347 provided on the upper region of the body 341 of the staple driving unit 340.

The second guide member 14 is disposed on the protection member 347 provided on the upper region of the body 341 of the staple driving unit 340.

The second guide member 14 is a plate body having a substantially rectangular shape elongated in the Y direction, and including the insertion hole 14*a* through which the pin 11 is inserted.

The material of the second guide member 14 is not particularly limited. For example, the second guide member 14 may be made of resin or metal. The second guide member 14 may be made of resin. When the second guide member 14 is made of resin, the pin 11 made of metal is allowed to smoothly pass through the second guide member 14.

The second guide member 14 is provided to increase the rigidity of the body 341 of the staple driving unit 340 in the Y direction. Particularly, the second guide member 14 functions as a second regulator for regulating, in cooperation with the pin 11, mechanical deviation in the Y direction produced when the presses 346, 346 press a sheet. More specifically, the second guide member 14 is connected with the stay U4 via the pin 11, the pin holding member 12, and the pin fixing member 13 by insertion of the pin 11 through the insertion hole 14*a*. In this case, when twisting force in the Y direction is generated in accordance with movement of the presses 346, 346 provided on the side walls 343, 343, the pin 11 and the insertion hole 14*a* of the second guide member 14 come into contact with each other to restrict a shift of the second guide member 14 in the Y direction. As a result, a shift of the protection member 347 fixed to the second guide member 14, and further shifts of the side walls 343, 343 in the Y direction are both prevented. Accordingly, the second guide member 14 functions as the second regulator for regulating mechanical deviation in the Y direction (i.e., short length direction of the second arm 346*a*) produced when the presses 346, 346 press a sheet.

The first guide member 15 is attached to the body 341 (cover portion 341*b*) of the staple driving unit 340 below the protection member 347 provided on the body 341 of the staple driving unit 340.

The first guide member 15 includes a horizontal portion 151 extending in a direction horizontal to the X-Y direction and in the X direction, and an attaching portion 152 provided at the front end of the horizontal portion 151.

The horizontal portion 151 includes the insertion hole 15*a* through which the pin 11 is inserted.

The insertion hole 15*a* is a long hole extending in the X direction. In this example, the insertion hole 15*a* is substantially rectangular. This shape allows the pin 11 inserted through the insertion hole 15*a* to shift in the X direction within the insertion hole 15*a*. More specifically, when the body 341 is moved in the X direction by the driving mechanism 342, the pin 11 shifts in the X direction within the insertion hole 15*a* accordingly.

The attaching portion 152 is extended downward from the front end of the horizontal portion 151. The lower end of the attaching portion 152 projects rearward. The front end of the cover portion 341*b* is fitted to this rearward projection of the attaching portion 152 such that the attaching portion 152 is detachably attached to the cover portion 341*b*.

The material of the first guide member 15 is not particularly limited. For example, the first guide member 15 may be made of resin or metal. The first guide member 15 may be made of resin. When the first guide member 15 is made of resin, the pin 11 made of metal is allowed to smoothly pass through the first guide member 15.

The first guide member 15 is provided to increase the rigidity of the body 341 of the staple driving unit 340 in the Y direction. Particularly, the first guide member 15 functions as a regulator for regulating, in cooperation with the pin 11, mechanical deviation in the Y direction produced when the staple driver 3411 drives a staple. More specifically, the first guide member 15 is connected with the stay U4 via the pin 11 by insertion of the pin 11 through the insertion hole 15*a*. In this case, when twisting force in the Y direction is generated in accordance with movement of the arm 341*a*, the pin 11 comes into contact with the first guide member 15 to restrict a shift of the first guide member 15 in the Y direction. As a result, shifts of the cover portion 341*b* and the arm 341*a* in the Y direction are prevented. Accordingly, the first guide member 15 functions as the regulator for regulating, in cooperation with the pin 11, mechanical deviation in the Y direction (i.e., short length direction of the arm 341*a*) produced when the staple driver 3411 drives a staple.

The foregoing components constituting the connection mechanism 10 are detachably attached to each other. For example, the pin 11 is detachably attached to the pin holding member 12, while the first guide member 15 is detachably attached to the cover portion 341*b*. Furthermore, the shaft 10A (pin 11 and pin holding member 12) are detachably attached to the pin fixing member 13. This detachability of the respective components facilitates processes such as installation, replacement of parts, and maintenance of the devices.

Returning to FIG. 1, the cutting unit 360 performs a cutting process for cutting edges of a saddle-stitched booklet. This process cuts irregular edges of the saddle-stitched booklet and forms uniform edges.

The square back forming unit 370 includes holding plates and rollers (both not shown), and others. The saddle-stitched booklet produced as above is sandwiched between the holding plates, and crushed by the rollers such that the crease becomes flat. As a result, the crease of the saddle-stitched booklet is formed into a square shape.

The discharging unit 380 discharges the saddle-stitched booklet subjected to the cutting process and/or the square back forming process. In this case, a saddle-stitch booklet subjected to neither the cutting process nor the square back forming process may be discharged.

The side stitching device 400 performs a side stitching process for a plurality of sheets, for example.

More specifically, the side stitching device 400 includes a staple processing unit which performs a staple process for a plurality of sheets received from the sheet processing device 300, a page end cutting unit which cuts edges for cutting off a part of ends in parallel with the spine of the plurality of sheets subjected to the staple process to form uniform ends, a discharging unit for discharging the sheets processed by the respective connected devices, and others, for example.

The side stitching device 400 may discharge the sheets received from the sheet processing device 300 while omitting a part or all of the respective processes performed by the side stitching device 400.

Operation control of the image forming system 1 is hereinafter described.

Figure 7:
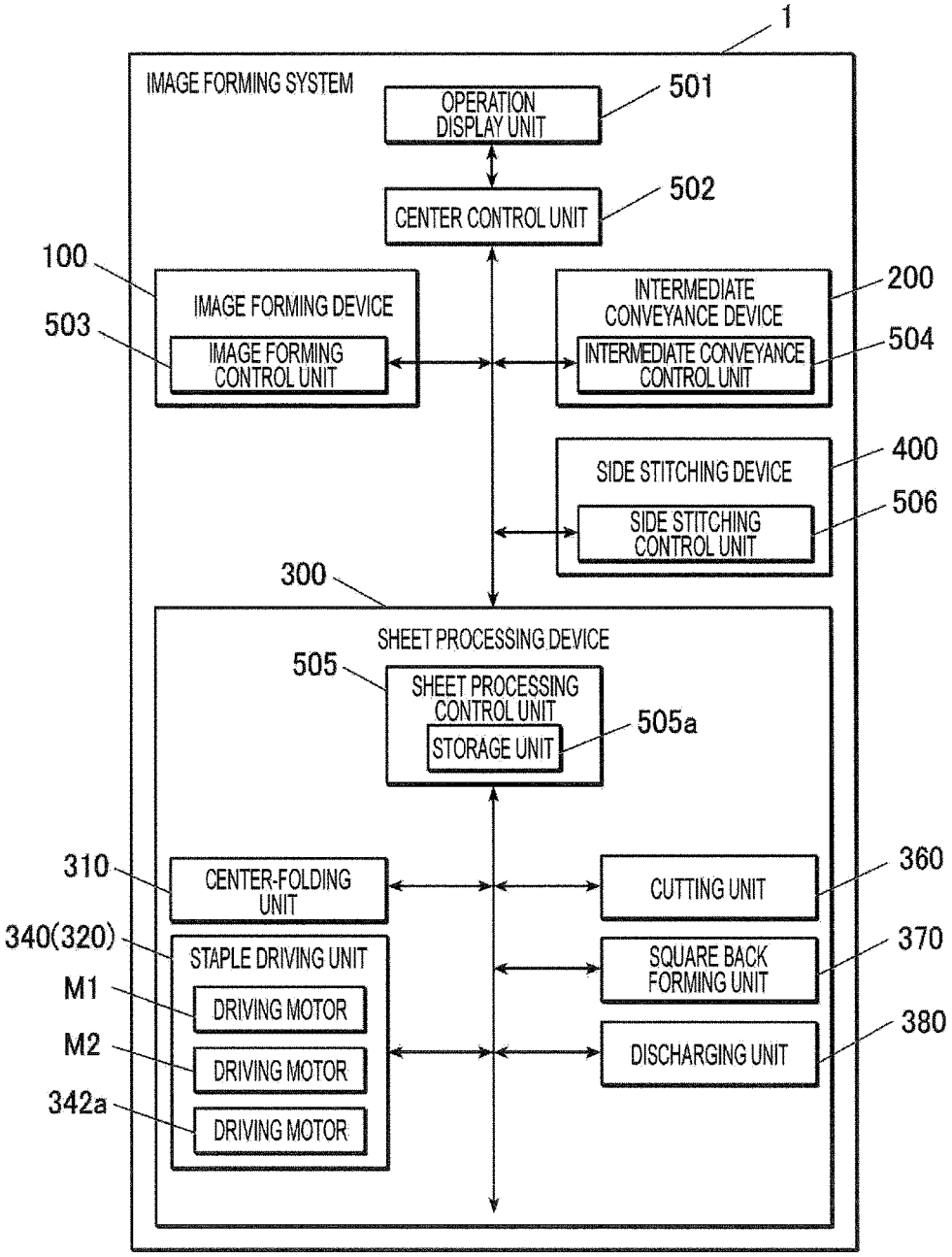
FIG. 7 is a block diagram illustrating a main configuration of operation control of the image forming system illustrated in FIG. 1.

FIG. 7 is a block diagram illustrating a main configuration associated with the operation control of the image forming system 1 according to one or more embodiments.

The image forming system 1 includes an operation display unit 501 which receives an input operation associated with the operation of the image forming system 1 from a user, and outputs display associated with the operation of the image forming system 1, a center control unit 502 which performs operation control of the entire image forming system 1, an image forming control unit 503 which controls operation of the image forming device 100, an intermediate conveyance control unit 504 which controls operation of the intermediate conveyance device 200, a sheet processing control unit (control unit) 505 which controls operation of the sheet processing device 300, and a side stitching control unit 506 which controls operation of the side stitching device 400.

The operation display unit 501 includes a touch panel type operation display device, switches and keys for various inputs, and others. The operation display unit 501 transmits signals corresponding to contents input from the user to the center control unit 502.

Each of the center control unit 502, the image forming control unit 503, the intermediate conveyance control unit 504, the sheet processing control unit 505, and the side stitching control unit 506 includes a CPU (central processing unit), a RAM (random access memory), a ROM (read only memory) and others to read software programs and various data corresponding to the processing contents and execute processing.

The center control unit 502 sets various conditions associated with the image forming system 1 in accordance with contents input from the user via the operation display unit 501.

These setting conditions include sheet size, number of colors for image formation (such as color, grayscale, and monochrome), number, type, size, and basis weight of a part of sheets subjected to saddle stitching and side stitching, number of staples driven to a crease of each sheet for saddle stitching, positions to which staples are driven for saddle stitching (stitching positions) and others.

The center control unit 502 outputs commands to the respective control units of the image forming control unit 503, the intermediate conveyance control unit 504, the sheet processing control unit 505, and the side stitching control unit 506 to perform processes corresponding to the setting contents. Each of the control units controls the corresponding control target device in accordance with the commands.

For example, the center control unit 502 outputs a command to the sheet processing control unit 505 to perform the saddle stitching process.

In response to this command, the sheet processing control unit 505 allows the saddle stitching unit 320 to perform the saddle-stitching process.

In this case, the sheet processing control unit 505 refers to a storage unit 505*a* contained in the sheet processing control unit 505.

The storage unit 505*a* stores a table which correlates a thickness of a bundle of sheets accumulated on the saddle portion 331 with a shift amount of the body 341.

The sheet processing control unit 505 calculates the thickness of the bundle of sheets according to the setting conditions (type, basis weight, number of sheets), and determines a shift amount of the body 341 from a predetermined reference position in accordance with the thickness of the bundle of sheets with reference to the table of the storage unit.

Instead of the table, arithmetic expressions may be stored beforehand to calculate a shift amount of the staple driver based on the type, basis weight, and number of sheets.

Operation of the staple driving unit 340 executed in the saddle stitching process according to this embodiment is hereinafter described.

Figure 8:
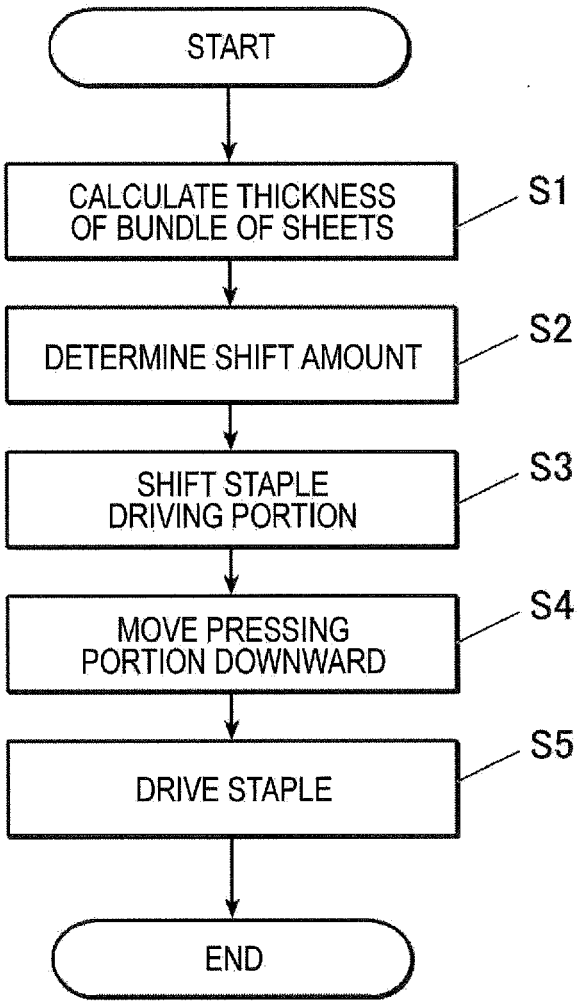
FIG. 8 is a flowchart illustrating operation of the staple driving unit in a saddle stitching process according to one or more embodiments of the invention.

FIG. 8 is a flowchart illustrating the operation of the staple driving unit 340 executed in the saddle stitching process according to one or more embodiments.

It is assumed in the saddle stitching process that the sheet processing control unit 505 allows the center-folding unit 310 to sequentially perform the center-folding process for a predetermined number of sheets constituting a booklet, and sequentially convey the center-folded sheets toward the saddle portion 331 of the accumulator 330 to place the center-folded sheets on the saddle portion 331.

At the time when the sheets reach the saddle portion 331 of the accumulator 330 and lie on the saddle portion 331, the staple driving unit 340, the accumulator 330, and the staple receiver 350 are separated from each other under the control of the sheet processing control unit 505.

Initially, the sheet processing control unit 505 calculates the thickness of the bundle of sheets based on setting conditions (step S1).

The sheet processing control unit 505 determines a shift amount of the body 341 shifted by the driving mechanism 342 in accordance with the thickness of the bundle of sheets calculated in step S1 with reference to the storage unit 505*a* (step S2). In this case, the sheet processing control unit 505 determines the shift amount of the staple driver 3411 shifted by the driving mechanism 342 such that the staple driver 3411 comes to a position facing a sheet binding position of the bundle of sheets closest to the staple driver 3411.

The sheet processing control unit 505 drives the driving motor 342*a* to operate the eccentric cam 342*c* and the pushing member 342*d*, and shift the body 341 in accordance with the operation of the eccentric cam 342*c* and the pushing member 342*d* (step S3).

The sheet processing control unit 505 drives the driving motor M2 to rotate the second arm 346*a* around the rotational axis G2. This rotation allows the presses 346, 346 to move downward, and hold the bundle of sheets in such a manner that the bundle of sheets are sandwiched between the presses 346, 346 and the support portions 352, 352 (step S4). When the presses 346, 346 move downward (rotate) and produce twisting force in the Y direction in accordance with the downward movement, the pin 11 fixed to the stay U4 restricts a shift of the second guide member 14 in the Y direction. This restriction prevents shifts of the protection member 347 and the side walls 343, 343 in the Y direction.

The sheet processing control unit 505 drives the driving motor M1 to rotate the arm 341*a* of the body 341 around the rotational axis G1. This rotation allows the arm 341*a* of the body 341 to drive a staple (step S5). When the downward movement (rotation) of the arm 341*a* of the body 341 produces twisting force in the Y direction, the pin 11 fixed to the stay U4 restricts a shift of the first guide member 15 in the Y direction. This restriction prevents shifts of the cover portion 341*b* and the arm 341*a* in the Y direction.

When the body 341 moves in the X direction, the pin 11 shifts in the X direction within the insertion hole 15*a* of the first guide member 15. Accordingly, the pin 11 does not affect adjustment of the position of the body 341 in the X direction.

According to one or more embodiments, there are provided the accumulator 330 on which sheets are accumulated, the staple driver 3411 which drives a staple into a bundle of sheets accumulated on the accumulator 330, the staple receiver 350 provided at a position facing the staple driver 3411 with the bundle of sheets sandwiched between the staple receiver 350 and the staple driver 3411, an arm 341*a* which extends in the direction perpendicular to the staple driving direction for driving the staple from the staple driver 3411 (Z direction) to allow operation of the staple driver 3411 in the staple driving direction, and the pin 11 and the first guide member 15 (regulator) which regulate deviation of the arm 341*a* in the Y direction produced when the staple driver 3411 drives the staple.

This structure reduces mechanical deviation in the Y direction produced by twisting force in the Y direction generated when the staple driver 3411 drives the staple into the sheets. Moreover, this structure prevents a shift of a binding position from a predetermined position in the Y direction, thereby preventing buckling of the staple.

According to one or more embodiments, the arm 341*a* rotates the staple driver 3411 relative to the bundle of sheets to allow operation of the staple driver 3411 in the Z direction.

It is considered that a structure requiring rotation of the arm 341*a* more easily generates twisting force in the Y direction. The structure according to this embodiment, however, prevents mechanical deviation in the Y direction produced by twisting force in the Y direction generated when the staple driver 3411 rotates and drives the staple into the sheets.

According to one or more embodiments, the accumulator 330 includes the saddle portion 331 on which creased V-shaped sheets are accumulated in a straddling state. The staple driver 3411 is provided above the accumulator 330 to drive the staple in the up-down direction.

This structure accumulates the sheets constituting the bundle of sheets in a state of alignment of creases of the sheets and in a straddling state over the saddle portion 331, and performs the saddle stitching process in a state of alignment of the positions of the respective sheets.

In case of the structure which performs the saddle-stitching process in such a state that sheets are accumulated on the saddle portion 331, twisting force in the Y direction produced when the staple driver 3411 drives a staple into the sheets tends to increase. According to this embodiment, however, the regulator (pin 11 and first guide member 15) securely reduces mechanical deviation produced during the binding process, thereby avoiding buckling of the staple during the saddle stitching process.

According to one or more embodiments, there are provided the presses 346, 346 disposed at positions shifted from the staple driver 3411 in the short length direction of the arm 341*a* (Y direction) to press, from the staple driver 3411 side, the positions shifted from the binding position of the bundle of sheets in the short length direction of the arm 341*a* before the staple driver 3411 drives the staple.

This structure performs the binding process in a state of close contact between the respective sheets constituting the bundle of sheets, and prevents a shift of the position for driving the staple, and shifts of relative positions of the respective sheets.

The presses 346, 346 are disposed at the positions shifted from the staple driver 3411 in the short length direction to press the positions shifted from the binding position of the bundle of sheets in the short length direction. In this case, force in the Y direction is applied to the staple driver 3411 in correspondence with reaction force produced when the presses 346, 346 press the bundle of sheets. Moreover, according to the sheet processing device including the pair of presses 346, 346 in this embodiment, there is a possibility of a slight difference between the pair of presses 346, 346 in timing for pressing the bundle of sheets to occur, and a possibility of a slight difference between the pair of presses 346, 346 in force for pressing the bundle of sheets to occur. In these situations, the force in the Y direction produced when the presses 346, 346 press the bundle of sheets and applied to the staple driver 3411 does not become uniform. As a result, force for twisting the staple driver 3411 in the Y direction is generated. According to one or more embodiments, however, the regulator (pin 11 and first guide member 15) securely reduces mechanical deviation produced during the binding process, thereby avoiding buckling of the staple during the saddle stitching process.

According to one or more embodiments, the regulator includes the shaft 10A which contains the pin 11 extending in the Z direction and supported by one member (stay U4) constituting the framework of the sheet processing device 300, and the first guide member 15 provided on the staple driver 3411 and including the insertion hole 15*a* through which the pin 11 is inserted.

This structure simplifies components for constituting the regulator.

According to one or more embodiments, there is provided the driving mechanism 342 which shifts the staple driver 3411 in the long length direction of the arm 341*a* (X direction) in accordance with the thickness of the bundle of sheets to such a position that the staple driver 3411 faces the sheet binding position of the bundle of sheets closest to the staple driver 3411. The insertion hole 15*a* is a long hole extending in the long length direction of the arm 341*a*.

This structure aligns the position for driving the staple by the staple driver 3411 with a ridge of the bundle of sheets, thereby accurately completing the binding process. Moreover, the pin 11 and the first guide member 15 do not interfere with a shift of the staple driver 3411 at the time of the shift of the staple driver 3411 in the X direction by the driving mechanism 342.

According to one or more embodiments, there is provided the presses 346, 346 disposed at positions shifted in the short length direction of the arm 341*a* (Y direction) from the staple driver 3411 to press, from the staple driver 3411 side, the positions shifted in the short length direction of the arm 341*a* from the binding position of the bundle of sheets before the staple driver 3411 drives the staple. There are further provided the second arm 346*a* extending in the direction perpendicular to the staple driving direction to allow operation of the presses 346, 346 in the staple driving direction, the pin 11, and the first guide member 15 including the insertion hole 15*a* through which the pin 11 is inserted. There is further provided the second guide member 14 which regulates deviation in the short length direction of the second arm 346*a* (Y direction) produced when the presses 346, 346 press the bundle of sheets.

This structure executes the binding process in a state of close contact between the respective sheets constituting the bundle of sheets, thereby reducing a shift of the position for driving the staple, and shifts of the relative positions of the respective sheets. Moreover, the second guide member 14 is capable of reducing mechanical deviation in the Y direction caused by twisting force in the Y direction produced when the presses 346, 346 press the sheets.

Furthermore, the identical pin 11 is used for both the regulator and the second regulator. In this case, the necessity of providing a plurality of shafts (pins) is eliminated, wherefore the configuration becomes simple.

According to one or more embodiments, the pin 11 is made of metal, while the first guide member 15 is made of resin.

This structure allows smooth insertion of the pin 11 through the first guide member 15.

According to one or more embodiments, the shaft 10A is detachably attached to the one member (stay U4), while the first guide member 15 is detachably attached to the staple driver 3411.

This structure facilitates processes such as installation, adjustment, and replacement of the respective components, for example.

According to one or more embodiments, the position of the shaft 10A with respect to the one member (stay U4) is adjustable when the shaft 10A is supported on the one member.

This structure allows appropriate positioning of the shaft 10A supported on the stay U4 via the pin fixing member 13. Accordingly, the functions of the pin 11 as the regulator or the second regulator are more securely achievable. For example, force may be applied in a direction of distortion of the stay U4, such as the Y direction, depending on inclination of the floor of the installation place, for example, at the time of installation of the sheet processing device 300 or the image forming system 1. Even in this situation, the shaft 10A is detachable from the one member (stay U4), and the position of the shaft 10A supported by the stay U4 is adjustable according to one or more embodiments. In this case, the shaft 10A is allowed to be fixed to the stay U4 at an appropriate position to which the force in the distortion direction is not applied. Accordingly, the function of the pin 11 as the regulator or the second regulator is more securely achievable, whereby shifts of the staple driver 3411 and the presses 346, 346 are avoidable during the binding process.

According to one or more embodiments, the accumulator 330 includes the saddle portion 331 on which V-shaped sheets are accumulated in a straddling state for execution of the saddle stitching process. However, the accumulator 330 maybe used for side stitching for sheets accumulated without creasing.

According to one or more embodiments, the staple driver 3411 is provided above the accumulator 330. In this case, the staple driving direction for driving the staple from the staple driver 3411 is the up-down direction. However, the staple driving direction may be directions other than the up-down direction. For example, the staple driver 3411 may drive the staple in the horizontal direction into not-creased sheets accumulated and held in the vertical direction by the accumulator 330.

According to one or more embodiments, the arm 341*a* rotates the staple driver 3411 relative to the bundle of sheets to allow operation of the staple driver 3411 in the up-down direction. However, the arm 341*a* may be vertically moved to allow operation of the staple driver 3411 in the up-down direction.

According to one or more embodiments, the regulator includes the pin 11 and the first guide member 15. However, the regulator may be constituted by rollers or plate bodies, for example, for pressurizing both sides of the staple driving unit 340 from the left and the right.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. A sheet processing device comprising:

an accumulator on which sheets are accumulated;

a staple driver;

a staple receiver disposed at a position facing the staple driver, wherein the staple driver drives a staple into the sheets when the sheets are between the staple receiver and the staple driver;

an arm that extends from the staple driver in a direction perpendicular to a staple driving direction to operate the staple driver in the staple driving direction; and a regulator that regulates deviation produced when the staple driver drives the staple, wherein the deviation is in a short length direction of the arm perpendicular to a long length direction of the arm and to the staple driving direction, and the regulator comprises:

a shaft extending in the staple driving direction and supported on one member constituting a framework of the sheet processing device, and a guide provided on the staple driver and comprising an insertion hole through which the shaft is inserted.

2. The sheet processing device according to claim 1, wherein the arm rotates the staple driver relative to the sheets to allow operation of the staple driver in the staple driving direction.

3. The sheet processing device according to claim 1, wherein the accumulator comprises a saddle portion on which creased V-shaped sheets are accumulated in a straddling state over the saddle portion, and the staple driver is provided above the accumulator to drive the staple in an up-down direction.

4. The sheet processing device according to claim 1, further comprising a press provided at a position shifted in the short length direction of the arm from the staple driver to press, from the staple driver side, the position shifted in the short length direction of the arm from a binding position of the sheets before the staple driver drives the staple.

5. The sheet processing device according to claim 1, further comprising a driving mechanism that shifts the staple driver in the long length direction of the arm, in accordance with a thickness of the sheets, to such a position that the staple driver faces a sheet binding position of the sheets closest to the staple driver, wherein the insertion hole extends in the long length direction of the arm.

6. The sheet processing device according to claim 1, further comprising:

a press provided at a position shifted in the short length direction of the arm from the staple driver to press, from the staple driver side, the position shifted in the short length direction of the arm from a binding position of the sheets before the staple driver drives the staple;

a second arm that extends in a direction perpendicular to the staple driver to allow operation of the press in the staple driving direction; and a second regulator that comprises a second guide comprising the shaft and an insertion hole through which the shaft is inserted, and regulates deviation in the short length direction of the second arm produced when the press presses the sheets.

7. The sheet processing device according to claim 1, wherein the shaft is made of metal, and the guide is made of resin.

8. The sheet processing device according to claim 1, wherein the shaft is detachably attached to the one member, and the guide is detachably attached to the staple driver.

9. The sheet processing device according to claim 8, wherein the position of the shaft with respect to the one member is adjustable when the shaft is supported on the one member.

10. An image forming system comprising:

an image forming device that forms an image on a sheet; and the sheet processing device according to claim 1 that performs a binding process for binding sheets via a staple after images are formed on the sheets by the image forming device.

* * * * *